United States Patent [19]

Suwa et al.

[11] Patent Number: 4,606,381

[45] Date of Patent: Aug. 19, 1986

[54] METHOD AND APPARATUS FOR AUTOMATICALLY EXCHANGING CLOTH ROLLERS IN A LOOM

[75] Inventors: Mitsuru Suwa; Shoichi Kuwabara, both of Kanazawa, Japan

[73] Assignee: Tsudakoma Kogyo Kabushiki Kaisha, Kanazawa, Japan

[21] Appl. No.: 701,501

[22] Filed: Feb. 14, 1985

[30] Foreign Application Priority Data

| | | | |
|---|---|---|---|
| Feb. 16, 1984 | [JP] | Japan | 59-28079 |
| Mar. 26, 1984 | [JP] | Japan | 59-58676 |
| Mar. 27, 1984 | [JP] | Japan | 59-60366 |

[51] Int. Cl.[4] ..... D03D 49/00

[52] U.S. Cl. ..... 139/1 R; 139/304; 242/66

[58] Field of Search ..... 139/1 R, 291 R, 304; 242/67.1 R, 66, 79, 78.7

[56] References Cited

U.S. PATENT DOCUMENTS

| | | | |
|---|---|---|---|
| 2,984,426 | 5/1961 | Johnson | 242/66 |
| 3,030,042 | 4/1962 | Gelleke | 242/66 |
| 3,848,826 | 11/1974 | Voswinckel | 242/66 |
| 3,880,374 | 4/1975 | Reiser | 242/67.1 R |
| 4,191,341 | 3/1980 | Looser | 242/67.1 R |
| 4,304,368 | 12/1981 | Bartmann | 242/66 |
| 4,360,170 | 11/1982 | Kuklies | 242/67.1 R |
| 4,408,727 | 10/1983 | Dropczynski | 242/66 |

*Primary Examiner*—Henry S. Jaudon
*Assistant Examiner*—Joseph S. Machuga
*Attorney, Agent, or Firm*—Staas & Halsey

[57] ABSTRACT

A method and an apparatus for automatically exchanging cloth rollers without stopping the loom, including: transferring a cloth roller from a truck to a loom when the cloth roller has taken up a given amount of cloth; mounting an empty roller on the loom while the cloth roller continues the take-up motion on the truck; and cutting the cloth between the truck and the loom to allow it to be taken up by the empty roller.

9 Claims, 20 Drawing Figures

METHOD AND APPARATUS FOR AUTOMATICALLY EXCHANGING CLOTH ROLLERS IN A LOOM

BACKGROUND OF THE INVENTION

Conventionally, cloth rollers in a loom have been exchanged by stopping the loom to manually cut the cloth in the transverse direction thereof when a cloth roller has taken up a given amount of cloth; removing the cloth roller from the loom to transfer it to a truck; mounting an empty roller on the loom to allow it to take up the cut cloth; and then starting the loom. This conventional method, however, is very time consuming. Particularly, in a high-speed loom, the output thereof is inevitably decreased by stopping the machine.

Some attempts have been made to automate the roller exchanging operation by utilizing robotics, but a robot is not yet available for conducting such operation speedily and without stopping the loom.

SUMMARY OF THE INVENTION

Accordingly, it is an object of the present invention to provide a method and an apparatus for automatically exchanging cloth rollers by: transferring a cloth roller during its take-up motion to a truck which is adapted to travel to a position adjacent to the loom and which is provided with arms capable of operating on a given signal; transferring via the arms an empty roller preloaded on the truck to a position above the cloth while it is taken up by the cloth roller on the truck; and transversely cutting the cloth near the empty roller now mounted on the loom, wherein the empty roller takes up a loom-side end of the cut cloth and the cloth roller takes up the other end.

In the present invention, unmanned control is also possible by automating the operations occurring before and after the truck exchanges rollers, for example, detecting that the cloth roller on the loom has taken up a given amount of cloth, calling the truck to a position adjacent to the loom, and sending orders for operating the arms to exchange the rollers and for returning the truck to a given place after the cloth roller transferred to the truck takes up the end of the cut cloth.

It is another object of the present invention to provide a mechanism for cutting cloth near an empty roller transferred to the loom, the cloth being taken up by a cloth roller transferred to the truck, and for allowing the empty roller to take up the loom-side end of the cut cloth. The mechanism includes: (a) cutting means adapted to slide transversely of the cloth near the transferred empty roller, while tensioning the cloth; and (b) means for slanting the end of the cut cloth so that it adheres around the transferred empty roller.

It is still another object of the present invention to provide a mechanism for taking up the end of the cut cloth, including: (a) means provided on the empty roller for holding the end of the cut cloth; and (b) means enabling the cut end to be securely taken up by the empty roller near the position where the empty roller is mounted on the loom.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

FIGS. 1 to 10 illustrate in order the operational steps of a fully automated or manually operated system for exchanging cloth rollers according to the present invention.

Figure 1:
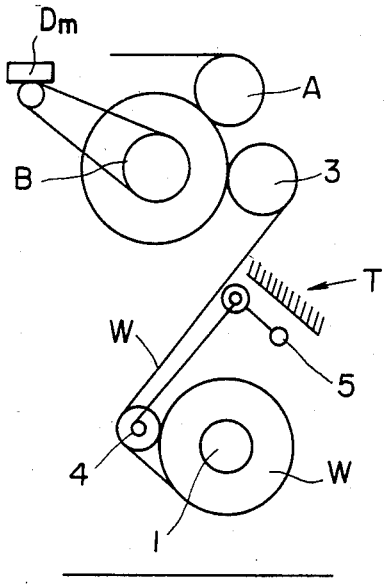
FIG. 1 is a side, elevational view illustrating a first, cloth roller mounted on a loom and taking up cloth.

FIG. 1 shows the condition in which a first, cloth roller mounted on a loom T has taken up a given amount of woven fabric or cloth W. A detection device detects when it is time to exchange the first, cloth roller. Referring to FIG. 1, the detection device consists of a take-up meter Dm for measuring the length of cloth taken up. When the meter reaches a predetermined value, a switch will be on and a signal will be given. In other words, when a predetermined amount of cloth has been taken up by the first, cloth roller 1, a wired or wireless signal will be sent indicating that it is time to exchange the roller. By this signal, a truck 2 (FIG. 2) is called to a position adjacent to the loom T. The truck 2 may be kept waiting at this position by calling it beforehand. Numeral 3 is a press roller and 4 a cloth press roller having a rotation stopper 5. A guide roller is shown as "A" and a friction roller as "B".

Figure 2:
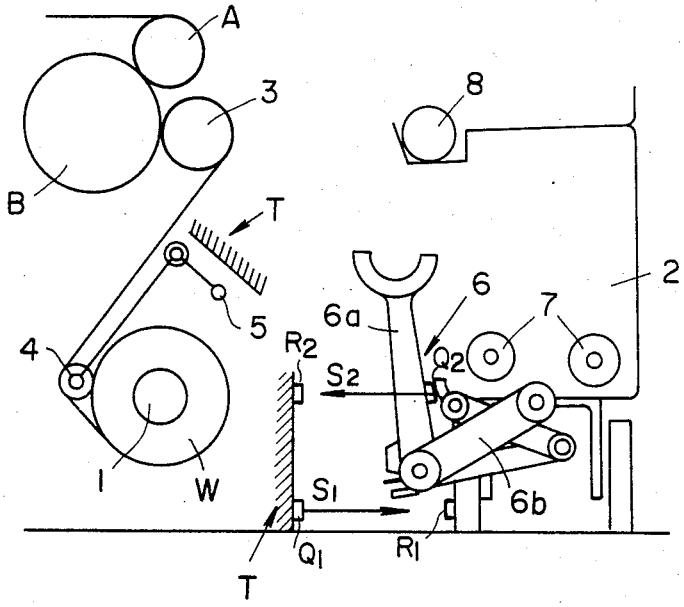
FIG. 2 is a side, elevational view illustrating a truck having arms which is used in combination with the loom shown in FIG. 1.

FIG. 2 shows the condition in which the truck 2 is set in the position adjacent to the loom T. The loom T is provided with an optical emitter Q1 and the truck 2 is provided with an optical receiver R1. When the optical receiver R1 receives a light from the optical emitter Q1, a signal S1 will be issued. Furthermore, the truck 2 is also provided with an optical emitter Q1 and the loom T is provided with an optical receiver R2. When the optical receiver R2 receives a light from the optical emitter Q2, a signal S2 will be issued. The truck 2 is adapted to stop and lock at a given position when both signals S1 and S2 exist.

Figure 3:
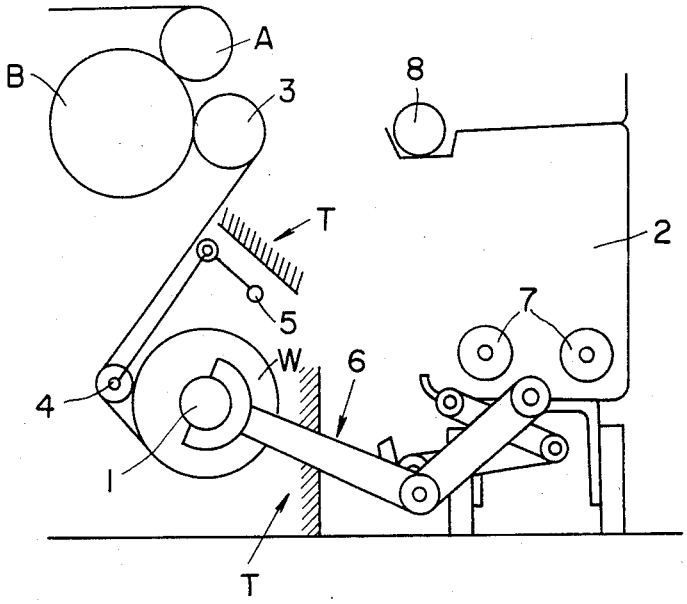
FIG. 3 is a side, elevational view illustrating the arms of the truck beginning to unload the first, cloth roller from the loom as the first, cloth roller continues to take up cloth.

FIG. 3 shows two parallel arms 6 which are mounted on the truck 2 and are adapted to exchange cloth rollers by, for example, reaching forward and holding the ends of the first, cloth roller 1 in response to an operational signal. In a manually operated system, this signal can be sent by pushing a button after the truck 2 locks. In an unmanned system, the truck 2 may be locked when both signals S1 and S2 exist, at the same time the operational signal may be emitted.

If the first, cloth roller 1 is supported on a bearing, (not shown), the first, cloth roller 1 must be disengaged from a driving shaft after detection of or in synchronization with the operation of the arms. However, the disengagement is not necessary if the first, cloth roller 1 rides on rotating rollers and is rotated thereby.

Figure 4:
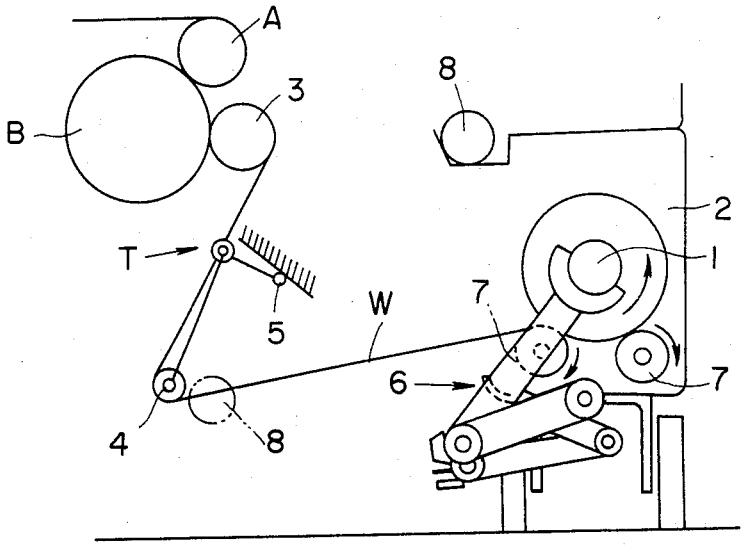
FIG. 4 is a side, elevational view illustrating the arms of the truck loading the first, cloth roller onto the truck as the first, cloth roller continues to take up cloth.

FIG. 4 shows the condition in which the first, cloth roller 1 held by the arms 6 is transferred from the loom T to the truck 2 and placed on a cloth roller support consisting of a pair of rotating rollers 7. The first, cloth roller 1 is rotated by these rotating rollers 7 so as to maintain take-up of the cloth by the first, cloth roller 1. The arms 6 are adapted for movement to allow release of the cloth W from the first, cloth roller 1 during transfer and to allow the first, cloth roller 1 to rotate again for take-up motion on the rotating rollers 7. Therefore, the exchange of cloth rollers is not an obstacle to the weaving operation, thereby eliminating the necessity of stopping the loom. The cloth press roller 4 is adapted by the rotation stopper 5 to stop a small distance from the phantom lines indicating where the second, empty roller 8 is to be mounted, and is adapted to guide the cloth W from the press roller 3 to the first, cloth roller 1.

Figure 5:
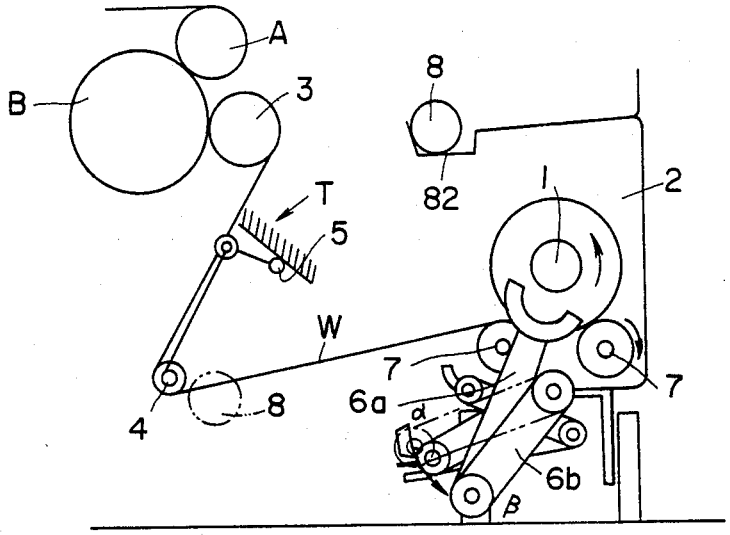
FIG. 5 is a side, elevational view illustrating the arms of the truck being released from the first, cloth roller loaded on the truck as the first, cloth roller continues to take up cloth.

FIG. 5 shows the condition in which, after the arms 6 have transferred the first, cloth roller 1 to position "$\alpha$", the arms 6 move to position "$\beta$", preparing to catch the second empty roller 8 loaded above on the truck 2 into roller support 82. The arm 6 moves back and forth with a forearm portion 6*a* and up and down with a rear arm portion 6*b*.

Figure 6:
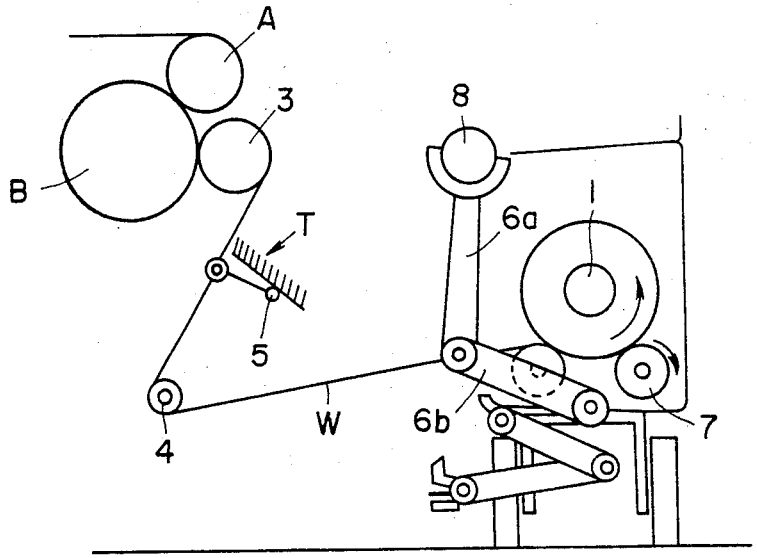
FIG. 6 is a side, elevational view illustrating the arms of the truck removing a second, empty cloth roller from the truck.

FIG. 6 shows the condition in which the arms 6 lift their hands to hold the ends of the second, empty roller 8 positioned on the truck 2. The arms 6 move upward from the position shown in FIG. 5, travelling on both sides of the cloth being taken up by the first, cloth roller 1.

Figure 7:
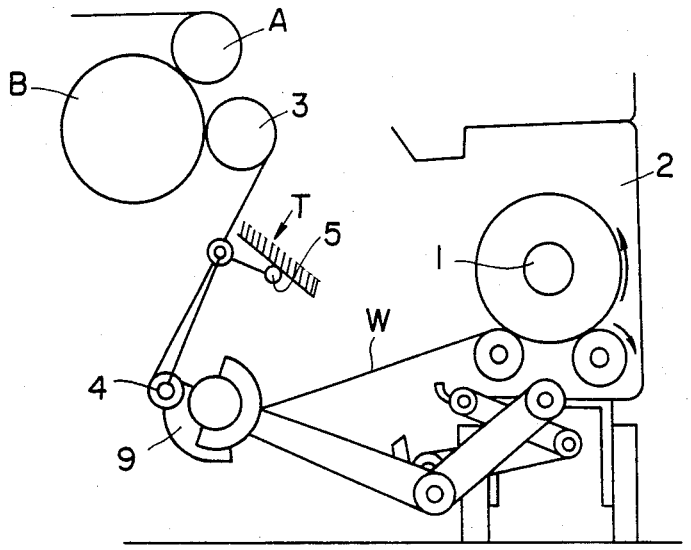
FIG. 7 is a side, elevational view illustrating the arms of the truck loading the second, empty cloth roller onto the loom.

FIG. 7 shows the condition in which the second, empty roller 8 is transferred to the loom T and mounted thereon. As mentioned above, the second, empty roller 8 may be mounted at this position by using the arms 6 when the second, empty roller 8 is to be rotated by the rotating rollers 7 to take up the cloth W. However, when the take-up motion of the second, empty roller 8 is to be provided by connecting the second, empty roller with a driving shaft, it is preferable to once support the ends of the second, empty roller 8 upon a roller rest 9 before connecting it with the driving shaft. When mounting the second, empty roller 8 on the loom T and the first, cloth roller 1 on the truck 2, the cloth W extends from the cloth press roller 4, under the second, empty roller 8 and onto the first, cloth roller 1, while it is being taken up by the first, cloth roller 1 under a certain tension.

Figure 8:
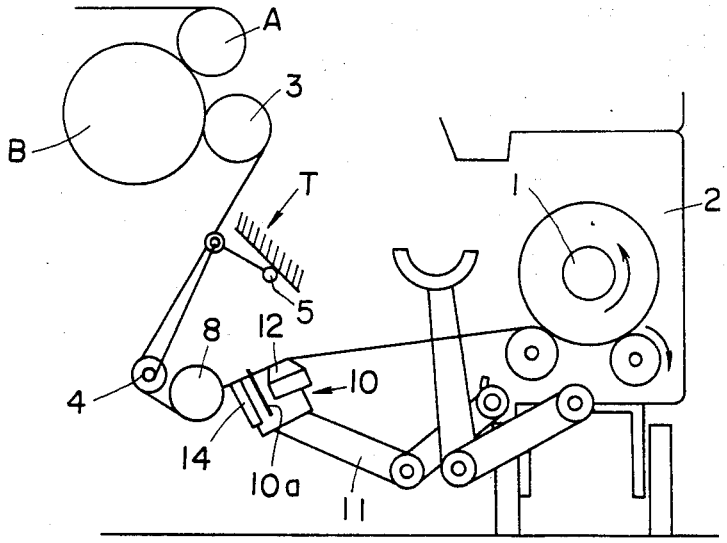
FIG. 8 is a side, elevational view illustrating the arms of the truck being removed from the second, empty cloth roller and a cloth cutter moving into position to cut the cloth which continues to be taken up by the first, cloth roller.

FIG. 8 shows the condition in which, after mounting the second, empty roller on the loom T, the cloth W is being transversely cut near the second, empty roller 8. Cutting means 10 slides in the direction transverse of the length of the cloth W and is so adapted by an arm 11 as to push the cloth W upwardly near the second, empty roller 8. The cutting means 10 has a slide bar 12 extending in the transverse direction, a nozzle 14 for discharging air or water and a blade 10*a* which is located between the slide bar 12 and the nozzle 14.

Figure 9:
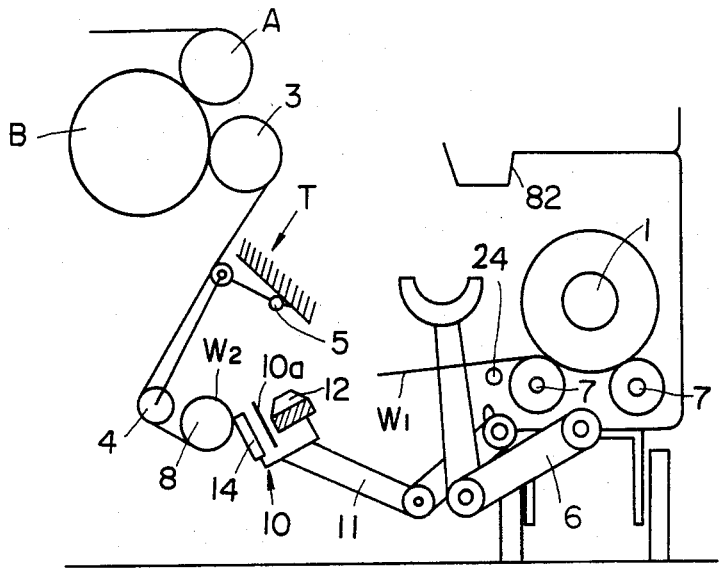
FIG. 9 is a side, elevational view illustrating the cloth cutter cutting the cloth as it continues to be taken up by the first, cloth roller on the truck.

FIG. 9 shows the condition in which the loom-side end W2 of the cut cloth W is adhered to the outer circumferential surface of the second, empty roller 8 by air or water discharged from the nozzle 14 and then starts to be taken up by this second, empty roller 8, while the other end W1 is being taken up by the first, cloth roller 1 mounted on the truck 2. It is preferable to adhere the end W1 to the second, empty roller simultaneously with the cutting operation, by discharge of air or water from the nozzle 14 and/or by means for facilitating the adherence of the cut end W2 to the second, empty roller 8, such as by using suction from inside the second, empty roller 8, watering the outer circumferential surface of this second, empty roller 8 or forming a velcro-like surface capable of attaching the cut end W2 to the second, empty roller 8. Means 24 for detecting the end of the cut cloth W1 is provided near the first, cloth roller 1.

Accordingly, when the end W1 passes, a signal is emitted from the detection means 24 to stop the rotation of the first, cloth roller 1 and return the cutting means 10 to its original position. The truck 2 is provided with a limit switch LS and detects that the roller-exchanging operation has been completed when the limit switch LS is turned on by the returning cutting means 10.

Figure 10:
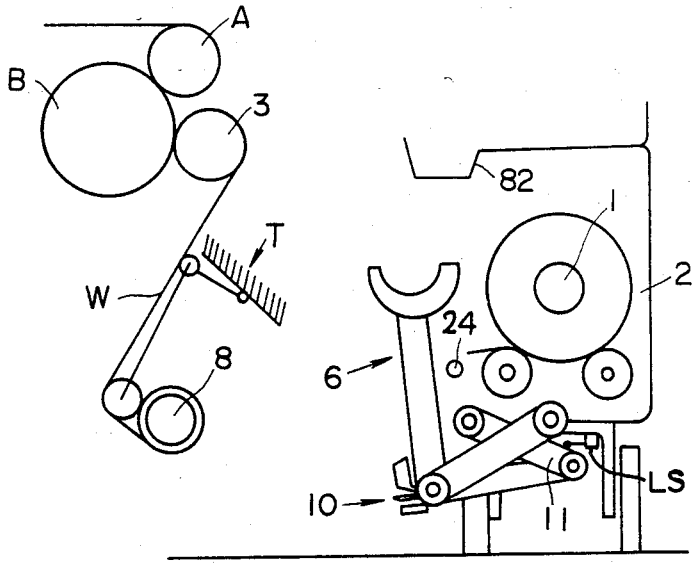
FIG. 10 is a side, elevational view illustrating the second, empty cloth roller as it begins taking up cloth.

FIG. 10 shows the condition in which the exchange of the cloth rollers 1 and 8 has been completed with the cutting means housed on the side of the truck 2 and the second, empty roller 8 on the loom T taking up the cloth W. The truck 2 detects the completion of the roller-exchange operation and thereafter moves to a cloth roller stocker (not shown).

The present invention enables: transfer of a cloth roller from a loom to a truck while the cloth roller is continuing a take-up motion; transfer of an empty roller from the truck to the loom; and automatic take-up of the end of the cut cloth on the empty roller and take-up of the other end on the cloth roller, thereby automating the exchange of the rollers without stopping the loom. Moreover, the present invention makes it possible to exchange rollers in an unmanned manner by automating such operations as calling and locating the truck, starting and completing the exchange and carrying the truck to the stocker.

Figure 11:
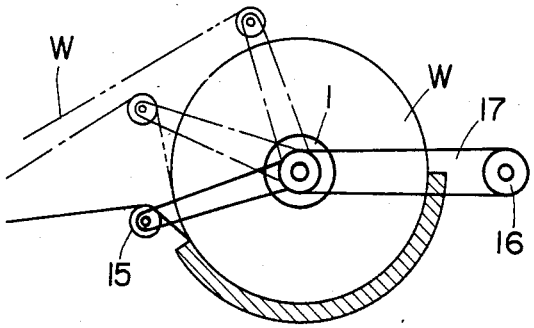
FIG. 11 is a side, elevational view illustrating a cloth roller support according to the present invention, which is a device for tensioning cloth when the cloth is cut and for taking up the cut cloth onto a cloth roller.

The arm 6 described above has two shafts, but the same function can be achieved by a one-shaft arm which is capable of both up-an-down and back-and-forth movements. Furthermore, the first, cloth roller 1 on the truck 2 may rotate on the pair of rotating rollers 7 shown in FIGS. 4 and 10, as described above, thereby tensioning the cloth W when it is cut and taking it up as well. However, such a tension-providing operation and take-up motion is also possible by moving a tension roller 15 around an immovable first, cloth roller 1 via a belt drive 17 around a timing pulley 16, as shown in FIG. 11.

Figure 12:
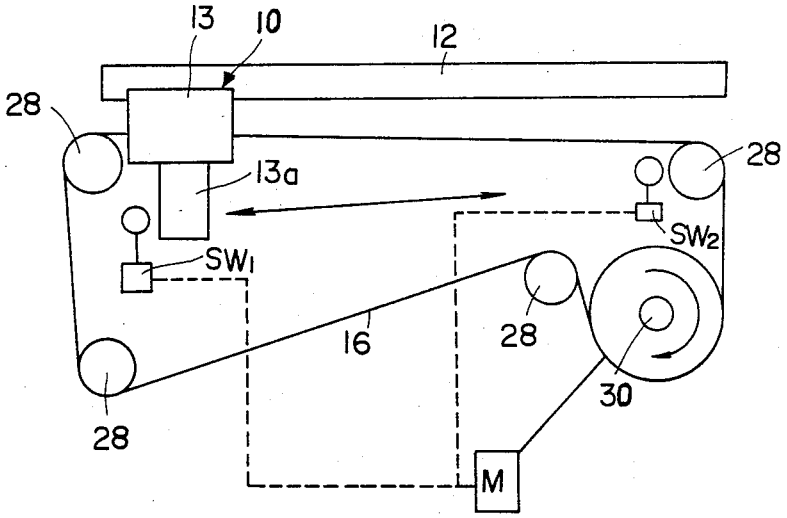
FIG. 12 is a plan view illustrating a first embodiment of means for cutting the cloth and taking up the end thereof.

The cutting means 10 will now be explained in detail with reference to FIGS. 12 and 13.

The cutting means 10 is mounted on the foremost end of the two-joint arm 11 provided on the truck 2. The cutting means 10 has its blade 10*a* slidably mounted, via a runner 13, on the slide bar 12 extending transversely of the cloth W and the runner 13 is fastened on a belt 16. The cutting means 10 is adapted to shuttle across the cloth W by alternating the rotational direction of a driving pulley 30 which is connected by the belt 16 with pulleys 28 and is rotated by a motor M.

Figure 13:
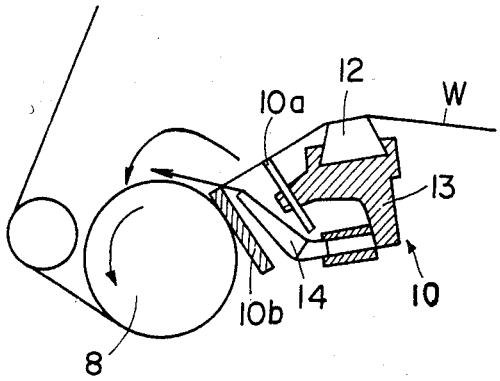
FIG. 13 is a side, elevational view, illustrating the first embodiment of means for cutting the cloth and taking up the end thereof.

As shown in FIG. 13, the runner 13 is provided with the nozzle 14 pointing near the position where the second, empty roller 8 meets with the cutting means 10, and is adapted to move across the cloth W together with the blade 10*a*. The direction of movement of the blade 10*a* and the nozzle 14 is controlled by limit switches SW1 or SW2 (FIG. 12), each of which is operated by a projecting portion 13*a* of the runner 13.

As shown in FIGS. 8 and 13, the cloth W extending under the second, empty roller 8 mounted on the loom T and to the first, cloth roller 1 mounted on the truck 2, will be tensioned between the slide bar 12 and the guide 10*b* when the cloth W is lifted a little. Therefore, the cloth W will be cut smoothly and straight when the blade 10*a* slides. As the nozzle 14 slides together with the blade 10*a*, discharging a fluid, such as air or water, to the outer circumferential surface of the second, empty roller 8, the end W2 of the cut cloth will be adhered to and taken up by the second, empty roller 8 simultaneously with the cutting.

Figure 14:
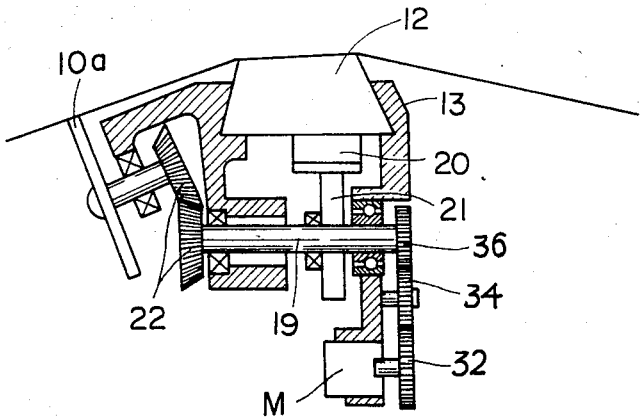
FIG. 14 is a side, elevational view illustrating a second embodiment of the means for cutting the cloth and taking up the end thereof.

Another means for cutting and taking up the cloth is shown in FIG. 14. This means has a slide bar 12 extending transversely of the length of the cloth W and a runner 13 slidably mounted thereon and provided with a motor M. The motor drive is transmitted via transmission gears 32, 34 and 36 to a driving shaft 19, which has a pinion 21 fixed thereon and meshing with a rack 20 provided on the lower surface of the slide bar 12. Therefore, the runner 13 slides along the slide bar 12 when the driving shaft 19 rotates. The driving shaft 19 has bevel gears 22 on its foremost end and rotates the blade 10*a* via the gears 22 to cut the cloth W.

Figure 15:
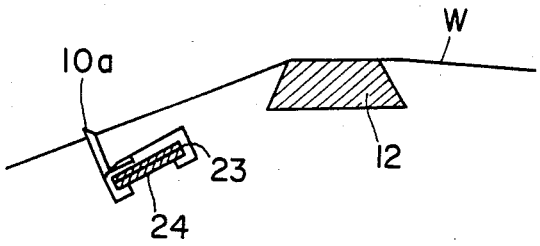
FIG. 15 is a side, elevational view of a drive mechanism according to a third embodiment of the means for cutting the cloth and taking up the end thereof.
Figure 16:
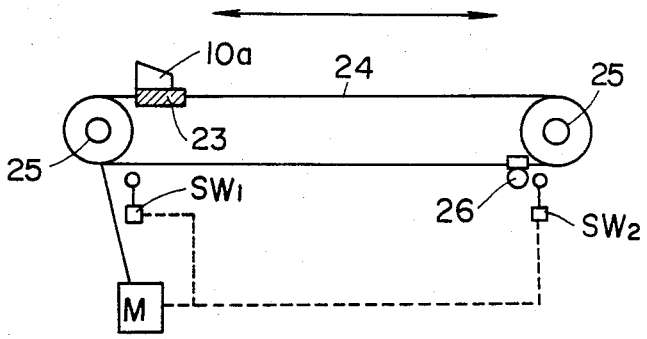
FIG. 16 is a plan view illustrating the drive mechanism as shown in FIG. 15.

As shown in FIG. 15 and 16, it is also possible to use the slide bar 12 merely as a means for tensioning the cloth W and to use a holder 23 having a blade 10*a* adapted to move transversely of the cloth W by a timing belt 24 mounted around pulleys 25 parallel to the slide bar 12. The moving direction of the holder 23 depends upon the rotational direction of the motor M controlled by, for example, connecting/disconnecting a connector 26 with the limit switches SW1 and SW2.

Figure 17:
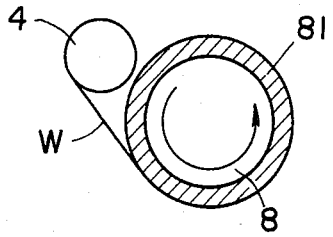
FIG. 17 is a side, elevational view of an empty roller according to the present invention.

As described above, the means for adhering and taking up the end of the cut cloth on the second, empty roller 8 uses discharged air or water to slant the end W2 toward the second, empty roller 8. Alternatively, the second, empty roller 8 may have a sponge-like, water-absorbent body 81 attached on the surface thereof, as shown in FIG. 17, which can absorb water to adhere the end of the cloth to the second, empty roller 8. The water-absorbent body 81 is watered while the second, empty roller 8 stays in the empty roller support 82 shown in FIG. 5 formed as, e.g., a water tank.

Figure 18:
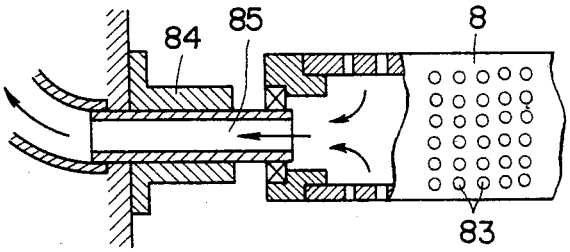
FIG. 18 is a partial, front, elevational view illustrating an alternate embodiment of a cloth roller.
Figure 19:
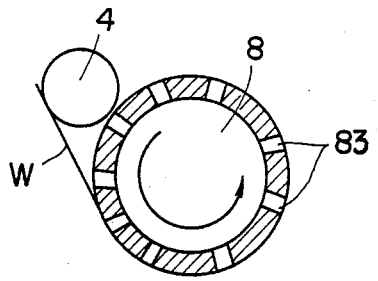
FIG. 19 is a side, elevational view of the cloth roller shown in FIG. 18.
Figure 20:
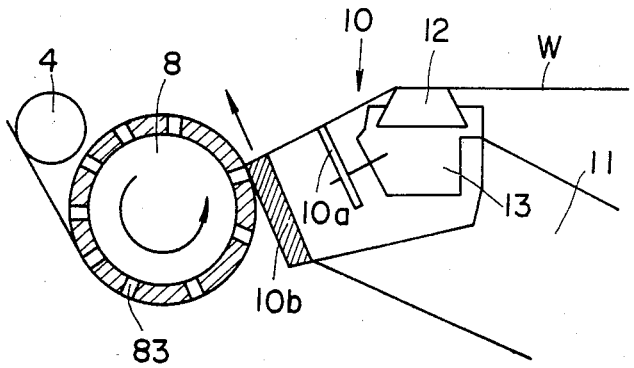
FIG. 20 is a side, elevational view illustrating a mechanism for taking up the end of the cut cloth according to the present invention.

Otherwise, the end W2 of the cut cloth W may be adhered to the second, empty roller 8 by suction from inside thereof. FIGS. 18 and 19 show this suction system, in which the end W2 is sucked up from many openings 83 formed in the outer circumferential surface of a hollow second, empty roller 8, via a passageway 85 extending through a bearing 84. The cutting means 10 is capable of upward and downward movement with its support arm 11 as shown in FIG. 20, and, therefore, the same effects can be achieved by sliding the guide 10*b* upwardly along the outer circumferential surface of the second, empty roller 8.

The foregoing is considered as illustrative only of the principles of the invention. Further, since numerous modifications and changes will readily occur to those skilled in the art, it is not desired to limit the invention to the exact construction and operation shown and described and, accordingly, all such suitable modifications and equivalents may be resorted to, falling within the scope of the invention and the appended claims and their equivalents.

What is claimed is:

1. A method for automatically exchanging first, and second, cloth rollers between a loom and a truck disposed adjacent to the loom, comprising the steps of:

(a) transferring a first, cloth roller during a take-up motion of cloth woven from the loom to a take-up device on the truck, wherein the first, cloth roller continues the take-up motion;

(b) transferring a second, empty roller from the truck to the loom;

(c) mounting the second, empty roller on the loom;

(d) transversely cutting the cloth being taken up by the first, cloth roller transferred to the truck; and (e) causing the second, empty roller to take up the loom-side end of the cut cloth.

2. The method as recited in claim 1, further comprising the steps of:

(f) providing the truck with (i) an arm for exchanging the first, and second, cloth rollers, and (ii) a cloth roller support including rotating means as the take-up device;

(g) operating the arm to transfer the first, cloth roller together with the cloth from the loom to the cloth roller support of the truck;

(h) transferring the second, empty roller loaded on the truck to the loom using the arm;

(i) mounting the second, empty roller on the loom to ride on the cloth, while the first, cloth roller is still taking up the cloth; and (j) transversely cutting the cloth near the second, empty roller mounted on the loom, the cloth extending under the second, empty roller to the first, cloth roller on the cloth roller support, to allow the second, empty roller to take up the loom-side end of the cut cloth and the first, cloth roller to take up other end.

3. The method as recited in claim 1, further comprising the steps of:

(f) providing the truck with (i) arms for exchanging the first, and second, cloth rollers, and (ii) a cloth roller support including rotating means as the take-up device;

(g) providing means for detecting when a predetermined amount of cloth is taken up by the first, cloth roller and issuing a detection signal and then for issuing a location signal and an exchange completion signal;

(h) calling the truck having the second, empty roller via the detection signal and then locating the truck at the position adjacent to the loom via the location signal;

(i) operating the arms mounted on the truck in response to the location signal to transfer the first, cloth roller in a take-up motion from the loom to the cloth roller support on the truck;

(j) operating the arms to transfer the second, empty roller loaded on the truck to the loom;

(k) mounting the second, empty roller on the loom to ride on the cloth, while the first, cloth roller is taking up the cloth;

(l) transversely cutting the cloth near the second, empty roller mounted on the loom, the cloth extending under the second, empty roller and to the first, cloth roller on the cloth roller support, to allow the second, empty roller to take up the loom-side end of the cut cloth and the first, cloth roller to take up the other end; and (m) returning the truck to the original position it had before responding to the detection signal via the exchange completion signal.

4. An apparatus for automatically exchanging cloth rollers in a loom, comprising:

(a) a first, cloth roller mounted on the loom to take up cloth;

(b) a truck including a take-up device to which the first, cloth roller is transferred from the loom and on which the first, cloth roller takes up the cloth;

(c) a second, empty roller loaded on the truck; (d) means for transferring the first, cloth roller from the loom to the truck;

(e) said means further being operative to transfer the second, empty roller from the truck to the loom;

(f) means for transversely cutting the cloth; and (g) means for directing the loom-side end of the cut cloth to the second, empty roller mounted on the loom.

5. The apparatus as recited in claim 4, wherein the cutting means comprises: a blade moving on a slide bar to traverse the cloth extending from the loom to the first, cloth roller on the truck and, wherein the cutting means is so constructed as to be able to approach the second, empty roller and to adhere the end of the cut cloth to the outer, circumferential surface of the second, empty roller by discharging a fluid from a nozzle pointing to the surface.

6. The apparatus as recited in claim 5, wherein the nozzle is movable on the slide bar together with the blade in a direction transverse of the length of the cloth.

7. The apparatus as recited in claim 6, further comprising:

(h) means for adhering and holding the cut cloth provided on the outer circumferential surface of the second, empty roller; and (i) means for guiding the loom-side end of the cut cloth to the outer circumferential surface provided near the second, empty roller mounted on the loom, thereby allowing the second, empty roller to take up the loom-side end of the cut cloth and continue the take-up motion of the cloth.

8. The apparatus as recited in claim 5, further comprising:

(h) means for adhering and holding the cut cloth provided on the outer circumferential surface of the second, empty roller; and (i) means for guiding the loom-side end of the cut cloth to the outer circumferential surface provided near the second, empty roller mounted on the loom, thereby allowing the second, empty roller to take up the loom-side end of the cut cloth and continue the take-up motion of the cloth.

9. The apparatus as recited in claim 5, further comprising:

(h) means for adhering and holding the cut cloth provided on the outer circumferential surface of the second, empty roller; and (i) means for guiding the loom-side end of the cut cloth to the outer circumferential surface provided near the second, empty roller mounted on the loom, thereby allowing the second, empty roller to take up the loom-side end of the cut cloth and continue the take-up motion of the cloth.

* * * * *

UNITED STATES PATENT AND TRADEMARK OFFICE

CERTIFICATE OF CORRECTION

PATENT NO. : 4,606,381

DATED : Aug. 19, 1986

INVENTOR(S) : Suwa et al.

It is certified that error appears in the above-identified patent and that said Letters Patent is hereby corrected as shown below:

Col. 7
Line 51, begin a new paragraph with --(d)--.

Col. 8
Line 20, "claim 6" should be --claim 4--;
Line 42, "claim 5" should be --claim 6--.

Signed and Sealed this

Tenth Day of February, 1987

*Attest:*

DONALD J. QUIGG

*Attesting Officer*

*Commissioner of Patents and Trademarks*